US009348257B2

(12) United States Patent
Ogiso et al.

(10) Patent No.: US 9,348,257 B2
(45) Date of Patent: May 24, 2016

(54) DEVELOPING DEVICE PROVIDED WITH DEVELOPING ROLLER AND THICKNESS REGULATION BLADE

(71) Applicant: BROTHER KOGYO KABUSHIKI KAISHA, Nagoya-shi, Aichi-ken (JP)

(72) Inventors: Marika Ogiso, Nagoya (JP); Masashi Imai, Kasugai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/664,450

(22) Filed: Mar. 20, 2015

(65) Prior Publication Data

US 2015/0277277 A1 Oct. 1, 2015

(30) Foreign Application Priority Data

Mar. 31, 2014 (JP) ..... 2014-071269

(51) Int. Cl.
*G03G 15/08* (2006.01)
*G03G 21/00* (2006.01)

(52) U.S. Cl.
CPC ..... *G03G 15/0812* (2013.01); *G03G 21/0011* (2013.01); *G03G 21/0017* (2013.01); *G03G 2215/0805* (2013.01)

(58) Field of Classification Search
CPC ..... G03G 15/0812; G03G 21/0011; G03G 21/0017; G03G 2215/0805
See application file for complete search history.

(56) References Cited

U.S. PATENT DOCUMENTS

2001/0055503 A1* 12/2001 Kin ..... G03G 15/065 399/284

FOREIGN PATENT DOCUMENTS

| | | | |
|---|---|---|---|
| JP | 04055872 A | * | 2/1992 |
| JP | H06186838 A | | 7/1994 |
| JP | H10104942 A | | 4/1998 |

* cited by examiner

*Primary Examiner* — Ryan Walsh
(74) *Attorney, Agent, or Firm* — Merchant & Gould P.C.

(57) ABSTRACT

In a developing device, a developing roller has an outer peripheral surface movable in a moving direction upon rotation of the developing roller to transfer developing agent to a developing region having a width in an axial direction of the developing roller. A thickness regulation blade includes a rubber portion. The rubber portion provides a contact region in contact with the outer peripheral surface to provide a nip region relative to the developing roller. The contact region includes a first region; and a second region. The first region and the second region each extends in the axial direction by a length at least equal to or greater than the width of the developing region. The first region has a first surface roughness. The second region is positioned downstream of the first region in the moving direction and has a second surface roughness finer than the first surface roughness.

19 Claims, 9 Drawing Sheets

DEVELOPING DEVICE PROVIDED WITH DEVELOPING ROLLER AND THICKNESS REGULATION BLADE

CROSS REFERENCE TO RELATED APPLICATION

This application claims priority from Japanese Patent Application No. 2014-071269 filed Mar. 31, 2014. The entire content of the priority application is incorporated herein by reference.

TECHNICAL FIELD

The present disclosure relates to a developing device that includes a developing roller and a thickness regulation blade regulating the thickness of developer carried by the developing roller.

BACKGROUND

Hitherto, a developing device in an electro-photographic image forming apparatus includes a casing, a developing roller, and a blade. The casing accommodates developer. The developing roller carries the developer. The blade contacts the developing roller with the developer interposed therebetween and regulates the thickness of the developer layer carried by the developing roller. Further, the blade includes a rubber portion and a support plate. The rubber portion regulates the thickness of the developer layer carried by the developing roller. The support plate supports the rubber portion.

In the developing device, the developing roller carries the developer accommodated in the casing. The rubber portion has a contact region that forms a nip with respect to the developing roller, and regulates the thickness of the developer layer carried by the developing roller in the contact region. Further, the developing roller carries the developer of which the thickness is regulated to a developing region between a photosensitive drum and the developing roller, and supplies the developer to an electrostatic latent image formed on the surface of the photosensitive drum, so that a developer image is formed thereon (see Japanese Patent Application Publication No. H06-186838).

SUMMARY

In the above-described technique, however, when the surface roughness of the contact region of the rubber portion is coarse, the thickness of the developer layer carried by the developing roller varies in a rotation axis direction of the developing roller. Thus, the developer density in an image printed on a sheet may be uneven in the rotation axis direction of the developing roller.

Meanwhile, when the surface roughness of the contact region of the rubber portion is fine, the thickness of the developer layer carried by the developing roller becomes substantially uniform in the rotation axis direction of the developing roller. However, when the surface roughness of the contact region of the rubber portion is fine, a friction force applied from the contact region of the rubber portion to the developer increases between the developing roller and the rubber portion. Then, the developer or the external additive released from the developer is locally fixed to the upstream end of the contact region at the nip of the developing roller in a moving direction.

Specifically, the developer layer carried on the developing roller is thinned while passing through the nip. That is, most developer passes through the upstream end of the contact region compared to the other portion of the contact region. Consequently, when the surface roughness of the contact region of the rubber portion is fine, the pressure between the rubber portion and the developing roller increases at the upstream end of the contact region, and the friction force applied from the contact region of the rubber portion to the developer increases between the rubber portion and the developing roller. Then, the developer or the external additive released from the developer is locally fixed to the upstream end of the contact region at the nip of the developing roller in the moving direction.

In this way, a region of the rubber portion where the developer or the external additive released from the developer is fixed thins the thickness of the developer layer more compared to a region where the developer or the external additive is not fixed. As a result, a vertical stripe may be formed on an image when the image is formed on the sheet.

In order to solve this problem, the surface roughness of the blade should be set optimally so that the above-described problems do not occur. However, highly precise processing is needed so as to optimally set the surface roughness of the blade, and hence the rubber portion is not easily produced.

In view of the foregoing, it is an object of the disclosure to provide a developing device capable of easily producing a thickness regulation blade while preventing failures in image formation.

In order to attain the above and other objects, the disclosure provides a developing device that includes a developing roller; and a thickness regulating blade. The developing roller is rotatable about a rotation axis defining an axial direction. The developing roller has an outer peripheral surface movable in a moving direction upon rotation of the developing roller to transfer developing agent to a developing region having a width in the axial direction. The thickness regulation blade includes a support portion; and a rubber portion. The rubber portion is supported by the support portion and provides a contact region in contact with the outer peripheral surface to provide a nip region relative to the developing roller. The rubber portion includes a first region; and a second region. The first region extends in the axial direction by a length at least equal to or greater than the width of the developing region, and is positioned in alignment with the developing region in the moving direction. The first region has a first surface roughness. The second region extends in the axial direction by a length at least equal to or greater than the width of the developing region, and is positioned in alignment with the developing region in the moving direction. The second region is positioned downstream of the first region in the moving direction and has a second surface roughness finer than the first surface roughness.

According to another aspect, the present invention provides a developing device that includes a developing roller; and a thickness regulation blade. The developing roller is rotatable about a rotation axis defining an axial direction. The developing roller has an outer peripheral surface movable in a moving direction upon rotation of the developing roller to transfer developing agent to a developing region having a width in the axial direction. The thickness regulation blade includes a support portion; and a rubber portion. The rubber portion is supported by the support portion and extends in the axial direction. The rubber portion has an upstream end in the moving direction, a first end portion and a second end portion in the axial direction, an inner side surface extending in the moving direction, an outer side surface extending in the moving direction and positioned outward of the inner side surface in the axial direction, and a bottom surface. A first notch and a second notch are formed in the first end portion and the second end portion, respectively. The first notch and the second notch each has an open end at the upstream end. The inner surface of the first notch and the inner surface of the second notch are aligned with a boundary of the developing region in the moving direction. The rubber portion provides a contact region in contact with the outer peripheral surface to provide a nip region relative to the developing roller. The contact region includes a first region; and a second region. The first region extends in the axial direction from the inner surface of the first notch to the inner surface of the second notch. The first region has a first surface roughness. The second region extends in the axial direction from a portion outward of the outer surface of the first notch to a portion outward of the outer surface of the second notch. The second region is positioned downstream of the first region in the moving direction and has a second surface roughness finer than the first surface roughness.

BRIEF DESCRIPTION OF THE DRAWINGS

The particular features and advantages of this disclosure as well as other objects will become apparent from the following description taken in connection with the accompanying drawings, in which:

FIG. 7A is an explanatory diagram explaining a process of a region corresponding to a first region of the rubber portion in the mold, FIG. 7B is an explanatory diagram explaining a process of a region corresponding to a second region of the rubber portion in the mold, FIG. 7C is an explanatory diagram explaining a process of a region corresponding to a third region of the rubber portion in the mold;

DETAILED DESCRIPTION

First Embodiment

Figure 1:
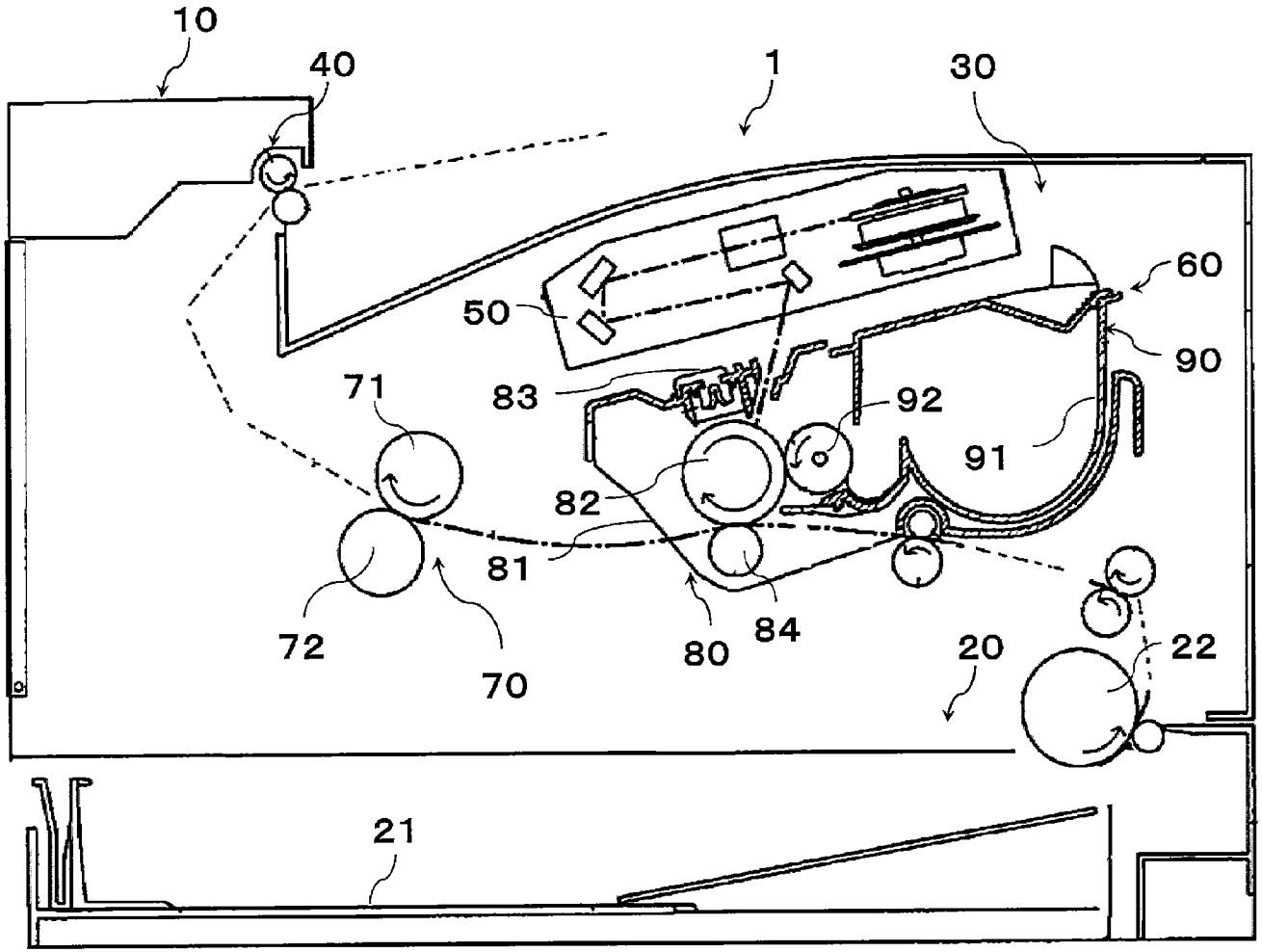
FIG. 1 is a schematic cross-sectional view of a laser printer.

The first embodiment will be described while referring to the accompanying drawings wherein like parts and components are designated by the same reference numerals to avoid duplicating description.

1. Overall Configuration of Laser Printer 1

First, an overall configuration of a laser printer 1 will be described with reference to FIG. 1. The laser printer 1 includes a main body frame 10, a sheet feeding unit 20, an image forming unit 30, and a sheet discharging unit 40. The sheet feeding unit feeds a sheet. The image forming unit forms an image on the sheet fed by the sheet feeding unit 20. The sheet discharging unit 40 discharges the sheet having an image formed thereon by the image forming unit 30 to the outside of the main body frame 10.

The image forming unit 30 includes an exposure device 50, a process unit 60, and a fixing device 70. The exposure device 50 is configured to form an electrostatic latent image on the outer peripheral surface of a photosensitive drum 82, and is disposed at the upper portion of the main body frame 10. The process unit 60 is attachable to or detachable from the main body frame 10, and includes a drum unit 80 and a developing unit 90 as an example of a developing device.

The drum unit 80 includes a drum frame 81, the photosensitive drum 82, a charger 83, and a transfer roller 84. The photosensitive drum 82 forms an electrostatic latent image on the outer peripheral surface thereof. The charger 83 uniformly charges the outer peripheral surface of the photosensitive drum 82. The transfer roller 84 transfers a developer image carried on the outer peripheral surface of the photosensitive drum 82 onto a sheet. The photosensitive drum 82 includes an image forming region A (see FIG. 4) where an electrostatic latent image is formed.

The developing unit 90 includes a developing frame 91 and a developing roller 92. The developing frame 91 is detachably attached to the drum unit 80 and accommodates developer. The developing roller 92 carries the developer. The developing roller 92 contacts the image forming region A of the photosensitive drum 82 so as to form a developing region B (see FIG. 4) between the developing roller 92 and the photosensitive drum 82. Further, the developing roller 92 carries the developer to the developing region B, and supplies the developer to the electrostatic latent image formed on the image forming region A of the photosensitive drum 82.

The fixing device 70 is configured to fix a developer image formed on the sheet. The fixing device 70 includes a heating roller 71 and a pressing roller 72. The heating roller 71 includes a heater. The pressing roller 72 contacts the heating roller 71. The developer image formed on the sheet is fixed onto the sheet while passing between the heating roller 71 and the pressing roller 72.

2. Configuration of Developing Unit 90

Next, the configuration of the developing unit 90 will be described with reference to FIG. 2.

Figure 2:
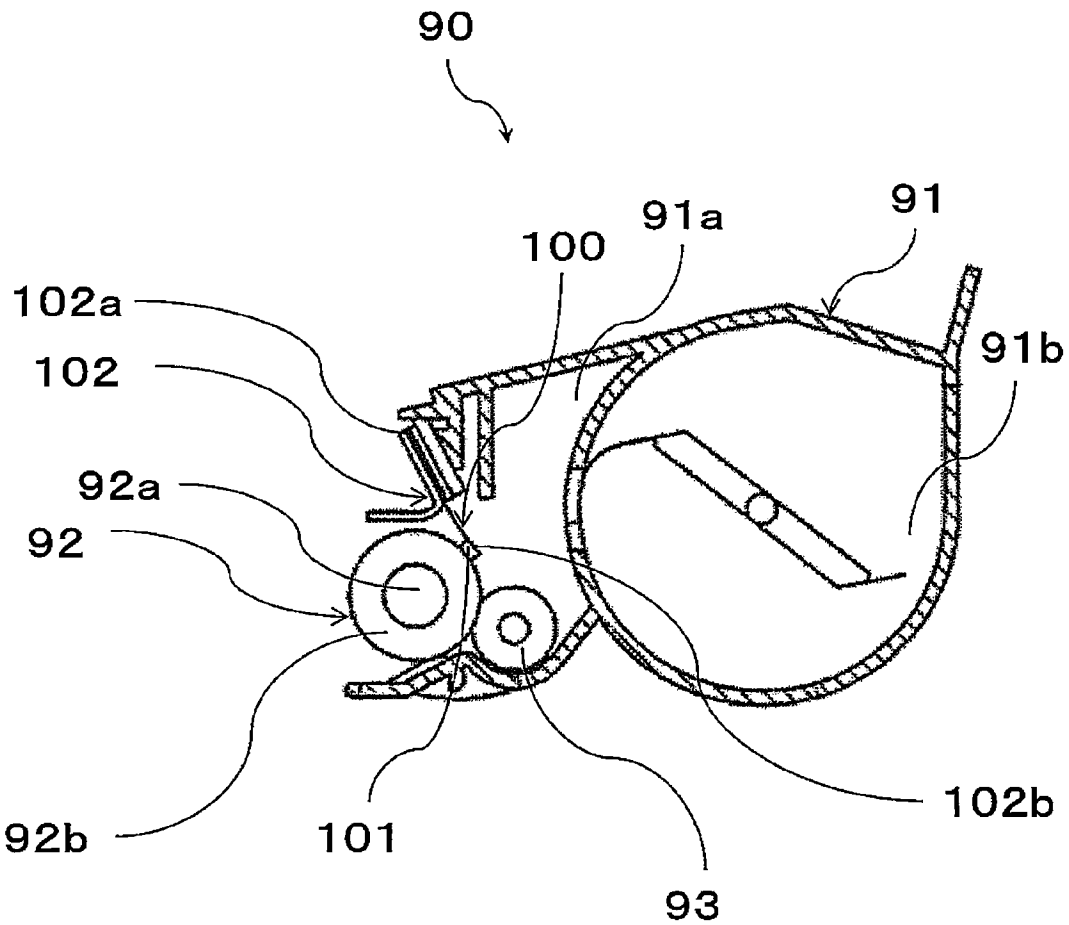
FIG. 2 is a schematic cross-sectional view of a developing unit.

As illustrated in FIG. 2, the developing unit 90 includes the developing frame 91, the developing roller 92, a supply roller 93, and a thickness regulation blade 100.

The developing frame 91 includes a developing chamber 91*a* and a developer accommodation chamber 91*b*. The developing chamber 91*a* supports the developing roller 92 and the supply roller 93. The developer accommodation chamber 91*b* accommodates the developer. In the present embodiment, the developer is a positively-chargeable non-magnetic monocomponent toner. Further, a silica particle as an example of an external additive for improving the flowability is added to the toner. Incidentally, the external additive may be titania or alumina.

The developing roller 92 is supported by the developing frame 91 through a bearing. The developing roller 92 includes a metal shaft 92*a* and an elastic layer 92*b*. The elastic layer 92*b* is provided in the periphery of the metal shaft 92*a*, and is formed of urethane rubber. Incidentally, the elastic layer 92*b* may be formed of silicone rubber. The supply roller 93 is supported by the developing frame 91. The supply roller 93 includes a metal shaft and an elastic layer. The elastic layer is provided in the periphery of the metal shaft, and is formed of a sponge.

The thickness regulation blade 100 is disposed so as to regulate the thickness of the developer layer carried by the developing roller 92. A base end of the thickness regulation blade 100 is supported by the developing frame 91, and the front end thereof contacts the developing roller 92 with the developer interposed therebetween. Further, the thickness regulation blade 100 includes a rubber portion 101 and a support plate 102. The support plate 102 supports the rubber portion 101. The rubber portion 101 is formed of silicone rubber, and is stuck to the support plate 102 with an adhesive. The support plate 102 is composed of an elastic thin metal plate. A base end 102*a* of the support plate 102 is supported by the developing frame 91, and a front end 102*b* thereof supports the rubber portion 101.

3. Detailed Description of Rubber Portion 101

Next, the rubber portion 101 as the characteristic portion of the embodiment will be described with reference to FIGS. 3 to 5.

Figure 3:
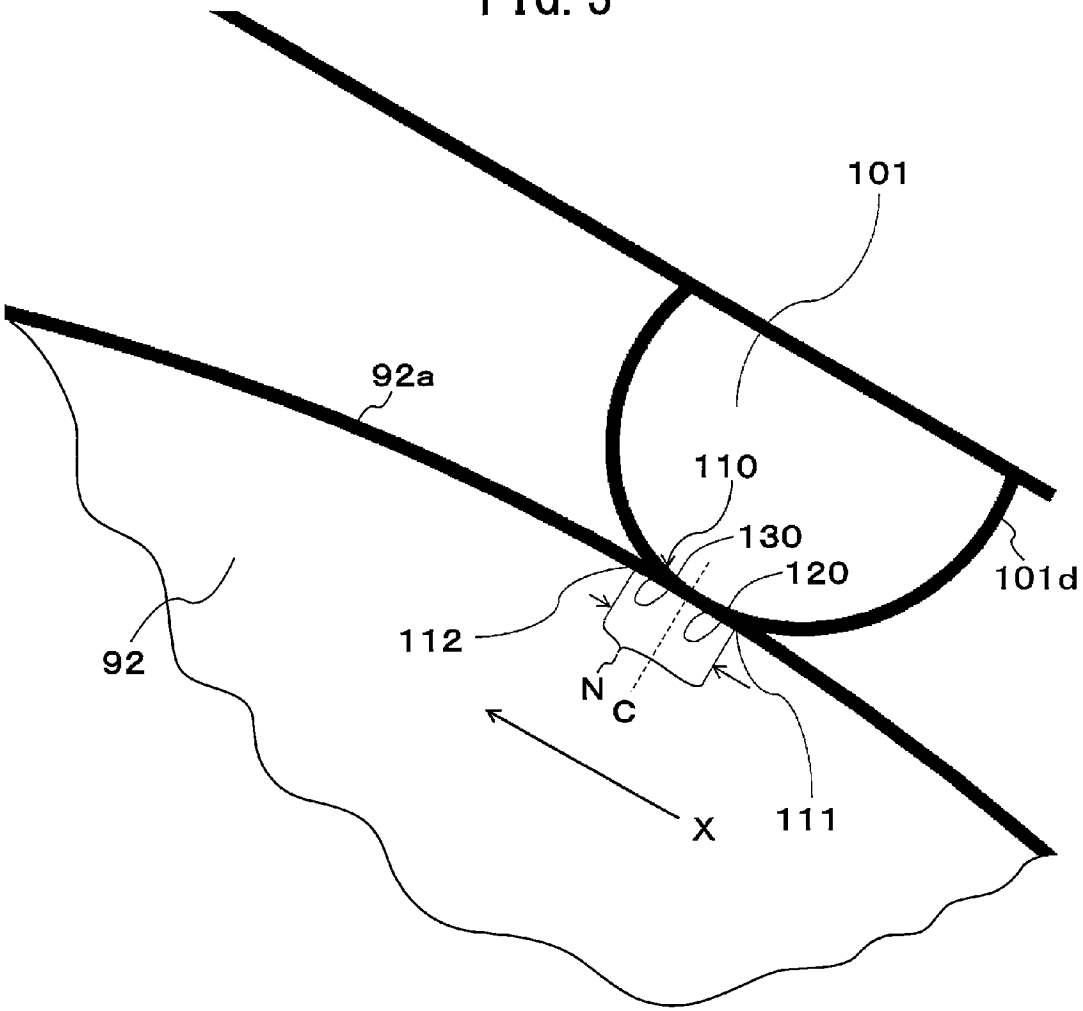
FIG. 3 is an enlarged view of a contact portion of a developing roller and a rubber portion of a thickness regulation blade.

As illustrated in FIG. 3, the rubber portion 101 is formed in a semi-cylindrical shape so as to protrude toward the developing roller 92. A surface 101*d* of the rubber portion 101 contacts an outer peripheral surface 92*a* of the developing roller 92 with the developer interposed therebetween, and includes a contact region 110 in contact with the outer peripheral surface 92*a* to provide a nip N relative to the developing roller 92. The contact region 110 includes a first region 120 and a second region 130. The first region 120 extends toward the downstream side from an upstream end 111 of the contact region 110 at the nip N of the developing roller 92 in the moving direction X. The second region 130 is disposed at the downstream side in relation to the first region 120 at the nip N of the developing roller 92 in the moving direction X.

The first region 120 extends from the upstream end 111 of the contact region 110 toward the center C of the nip N. The second region 130 extends from a downstream end 112 of the contact region 110 toward the center C of the nip N. Consequently, the first region 120 and the second region 130 are connected to each other at the center C of the nip N.

Figure 4:
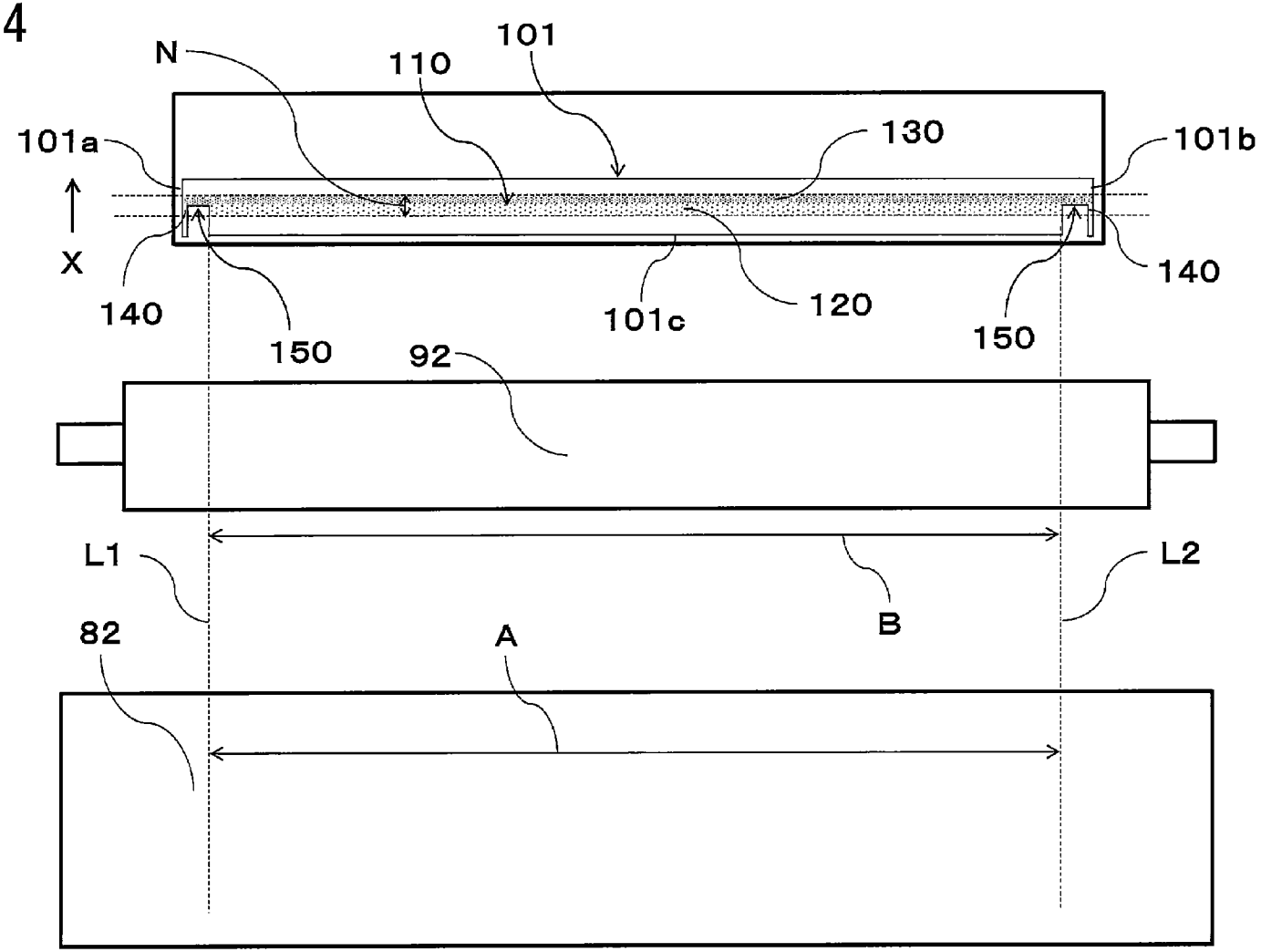
FIG. 4 is an explanatory diagram showing a positional relationship of a photosensitive drum, the developing roller, and the thickness regulation blade in a rotation axis direction of the developing roller.

As illustrated in FIG. 4, the first region 120 of the contact region 110 is disposed in the entire width of the developing region B, extending in the rotation axis direction by a length at least equal to the width of the developing region B. Specifically, the first region 120 is disposed at least from a first imaginary line L1 to a second imaginary line L2. The first imaginary line L1 passes through one end of the developing region B in the rotation axis direction of the developing roller 92 and is perpendicular to the rotation axis direction of the developing roller 92. The second imaginary line L2 passes through the other end of the developing region B in the rotation axis direction of the developing roller 92 and is perpendicular to the rotation axis direction of the developing roller 92. Incidentally, the width of the developing region B matches the width of the image forming region A of the photosensitive drum 82.

The second region 130 of the contact region 110 is disposed in the entire width of the developing region B, extending in the rotation axis direction by a length at least equal to the width of the developing region B. Specifically, the second region 130 is disposed from one end 101*a* of the rubber portion 101 to the other end 101*b* thereof in the rotation axis direction of the developing roller 92. Consequently, the dimension of the second region 130 in the rotation axis direction of the developing roller 92 is longer than the dimension of the first region 120 in the rotation axis direction of the developing roller 92. Incidentally, one end 101*a* of the rubber portion 101 is an end which is disposed at the left side when the drawing paper of FIG. 4 is viewed from the upside, and the other end 101*b* of the rubber portion 101 is an end which is disposed at the right side when the drawing paper of FIG. 4 is viewed from the upside.

Further, the surface roughness of the first region 120 is coarser than the surface roughness of the second region 130. In the present embodiment, the surface roughness is set as an arithmetic average roughness value Ra. It is preferable that the arithmetic average roughness value Ra of the first region 120 is within the range of 0.5 μm to 0.8 μm. It is further preferable that the arithmetic average roughness value Ra of the first region 120 is within the range of 0.6 μm to 0.7 μm. In the present embodiment, the arithmetic average roughness value Ra of the first region 120 is 0.6 μm.

It is preferable that the arithmetic average roughness value Ra of the second region 130 is within the range of 0.1 μm to 0.4 μm. It is further preferable that the arithmetic average roughness value Ra of the second region 130 is within the range of 0.2 μm to 0.3 μm. In the present embodiment, the arithmetic average roughness value Ra of the second region 130 is 0.2 μm. Further, the arithmetic average roughness value Ra of the first position 120 does not have an orientation. In addition, the arithmetic average roughness value Ra of the second region 130 does not have an orientation.

Here, the arithmetic average roughness value Ra can be measured by, for example, the following method. The surface roughness values of the first region 120 and the second region 130 are measured by SURFCOM 5000DX manufactured by TOKYO SEIMITSU CO., LTD. on the basis of JIS B0633. The measurement is performed while extraneous matter such as developer and the like is not stuck to the surfaces of the first region 120 and the second region 130. Further, the measurement direction of the surface roughness corresponds to two directions, that is, the rotation axis direction of the developing roller 92 and the moving direction X at the nip N of the developing roller 92, and the measurement position of the surface roughness corresponds to three positions, that is, one end, the center, and the other end of each of the first region 120 and the second region 130 in the rotation axis direction of the developing roller 92. The surface roughness values of the first region 120 and the second region 130 are calculated in a manner such that the surface roughness values measured at six positions in this way are averaged.

Further, the contact region 110 includes a pair of third regions 140 and a pair of notches 150. The pair of third regions 140 extend toward the upstream side in the moving direction X at the nip N of the developing roller 92 from both ends of the second region 130 in the rotation axis direction of the developing roller 92. The pair of notches 150 are disposed between the first region 120 and the pair of third regions 140 in the rotation axis direction of the developing roller 92. The pair of third regions 140 and the pair of notches 150 have the same structure respectively. In the description below, the third region 140 which is disposed at the left side when the drawing paper of FIG. 4 is viewed from the upside and the notch 150 which is disposed at the left side when the drawing paper of FIG. 4 is viewed from the upside will be described.

The third region 140 is disposed outside the developing region B. In other words, the third region 140 is disposed between one end 101*a* of the rubber portion 101 and the first region 120 in the rotation axis direction of the developing roller 92.

The notch 150 is disposed outside the developing region B. In other words, the notch 150 is disposed between the first region 120 and the third region 140. Further, the notch 150 is formed in such a way as to be recessed toward the downstream side at the nip N of the developing roller 92 in the moving direction X from an upstream end 101*c* of the rubber portion 101 at the nip N of the developing roller 92 in the moving direction X.

Figure 5:
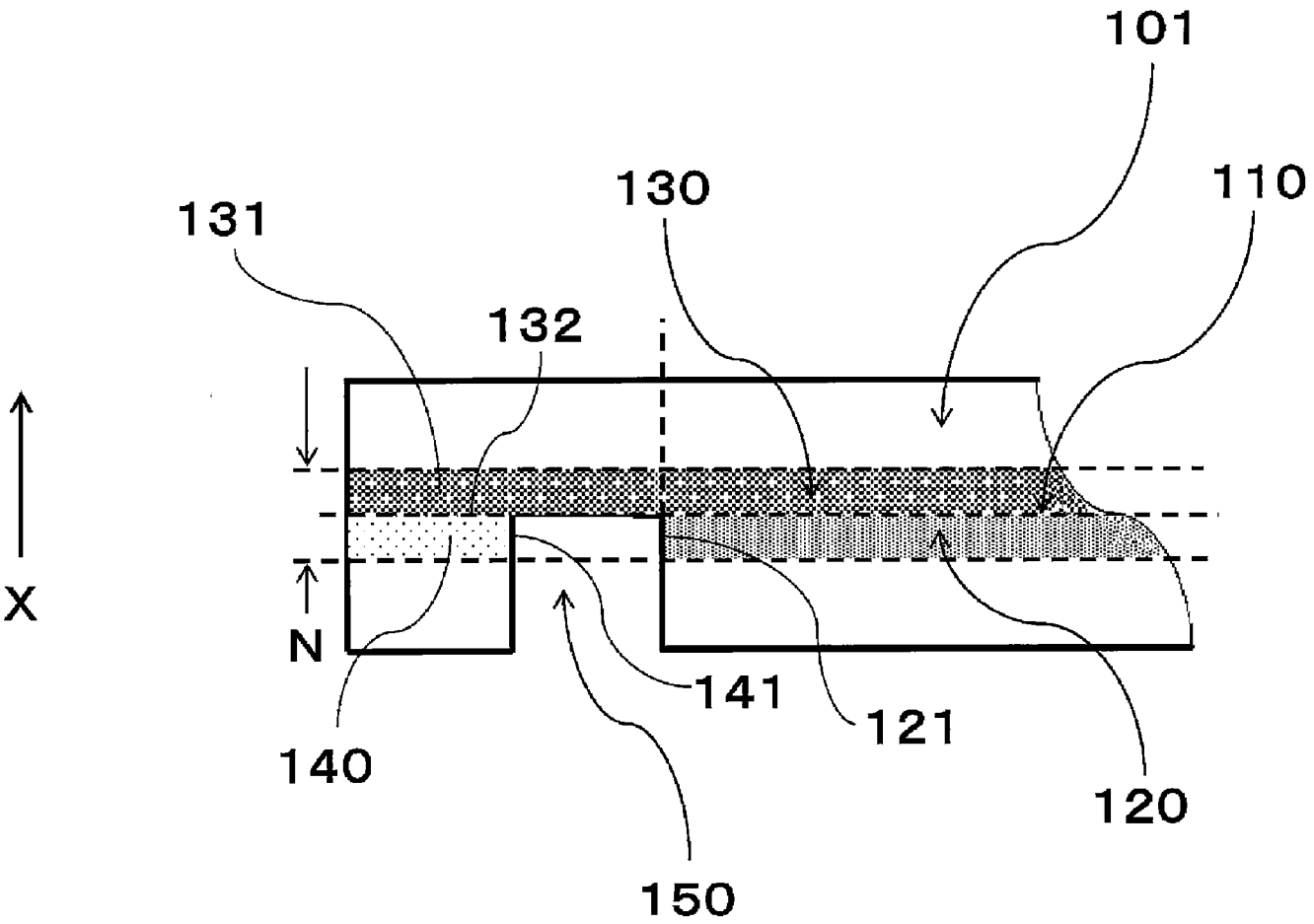
FIG. 5 is an enlarged view of one end of the rubber portion in the rotation axis direction of the developing roller.

Further, as illustrated in FIG. 5, the second region 130 of the contact region 110 includes an extension region 131 which extends in the rotation axis direction of the developing roller 92 with respect to one end 121 of the first region 120 in the rotation axis direction of the developing roller 92. Incidentally, one end 121 of the first region 120 is an end which is disposed at the leftmost side when the drawing paper of FIG. 5 is viewed from the upside among the ends of the first region 120 in the rotation axis direction of the developing roller 92.

The third region 140 extends toward the upstream side at the nip N of the developing roller 92 in the moving direction X from an upstream end 132 of the extension region 131 at the nip N of the developing roller 92 in the moving direction X. Further, the surface roughness of the third region 140 is coarser than the surface roughness of the first region 120. It is preferable that the arithmetic average roughness value Ra of the third region 140 is within the range of 0.8 μm to 1.4 μm. It is further preferable that the arithmetic average roughness value Ra of the third portion 140 is within the range of 1.0 μm to 1.2 μm. In the present embodiment, the arithmetic average roughness value Ra of the third region 140 is 1.0 μm. Consequently, the arithmetic average roughness values Ra of the first region 120, the second region 130, and the third region 140 increase in order of the second region 130, the first region 120, and the third region 140.

The notch 150 is formed in a portion which is surrounded by one end 121 of the first region 120 in the rotation axis direction of the developing roller 92, the upstream end 132 of the extension region 131 at the nip N of the developing roller 92 in the moving direction X, and one end 141 of the third region 140 in the rotation axis direction of the developing roller 92. Incidentally, one end 141 of the third region 140 corresponds to an end which is disposed near the first region 120.

In other words, the notch 150 has an open end at the upstream end of the rubber portion 101 in the moving direction X. The notch 150 also has an inner side surface, an outer side surface, and a bottom surface. The inner side surface of the notch 150 extends in the moving direction X and is aligned with one end 121 of the first region 120 in the rotation axis direction of the developing roller 92. The outer side surface of the notch 150 extends in the moving direction X and is aligned with an inner end of the third region 140 in the rotation axis direction of the developing roller 92. The bottom surface of the notch 150 extends in the rotation axis direction of the developing roller 92 and is aligned with the upstream end 132 of the extension region 131, the upstream end of the second region 130, and the downstream end of the first region 120. That is, in the present embodiment, the downstream end of the first region 120, the upstream end of the second region 130, the upstream end 132 of the extension region 131, and the bottom surface of the notch 150 are aligned with the center C of the nip N in the moving direction X.

4. Method of Processing Surface 101*d* of Rubber Portion 101 at Desired Surface Roughness Next, an example of a method of processing the surface 101*d* of the rubber portion 101 at a desired surface roughness will be described with reference to FIGS. 6 and 7.

The rubber portion 101 is molded by pouring melted urethane rubber into a mold 160. Further, a blasting process is performed on a portion corresponding to the contact region 110 of the rubber portion 101 in the mold 160 by an existing blasting device 170 in order to apply a desired surface roughness thereto. Hereinafter, a blasting process in the mold 160 will be described in detail.

First, there is a need to measure the dimension of the contact region 110 of the rubber portion 101 when a blasting process is performed on the mold 160. The dimension measurement method is performed in the following procedure.

First, the rubber portion 101 contacts the developing roller 92 which carries a thinned developer layer. At this time, the contact pressure of the rubber portion 101 with respect to the developing roller 92 is set to 5 N/m. Here, the contact pressure corresponds to the contact pressure when the developer layer is thinned by the rubber portion 101. Subsequently, the developing roller 92 is separated from the rubber portion 101. Then, the developer which is carried by the developing roller 92 is stuck to the rubber portion 101. At this time, the area of the developer stuck to the rubber portion 101 matches the contact region 110 of the rubber portion 101. That is, the dimension of the contact region 110 of the rubber portion 101 can be measured by measuring the dimension of the area of the developer stuck to the rubber portion 101.

Figure 6:
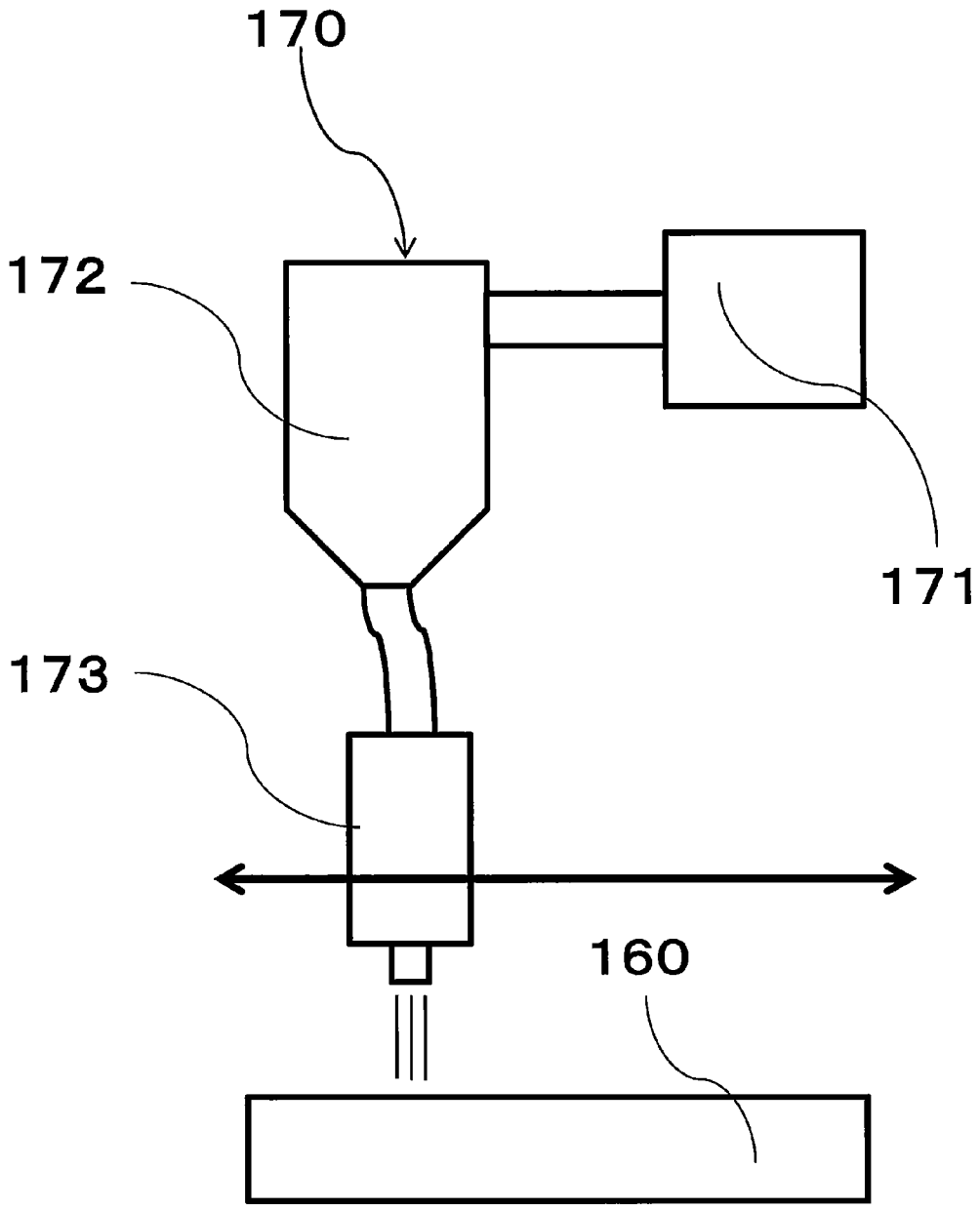
FIG. 6 is an explanatory diagram showing a device for processing a mold.

Next, a blasting process is performed on a portion corresponding to the contact region 110 of the rubber portion 101 in the mold 160. As illustrated in FIG. 6, the blasting device 170 includes a compressor 171, a pressurized tank 172, and a nozzle 173. The pressurized tank 172 has a gas therein. The nozzle 173 sprays a gas which is compressed by the compressor 171 and is stored inside the pressurized tank 171 toward the mold 160. The nozzle 173 is configured to spray the gas toward the mold 160 while moving in the right and left direction when the drawing paper of FIG. 6 is viewed from the upside. In other words, the nozzle 173 processes the mold 160 while moving in the right and left direction when the drawing paper of FIG. 6 is viewed from the upside.

Incidentally, the gas includes spherical glass beads. Further, the gas may include amorphous alumina particles. In addition, the blasting device 170 may appropriately change the degree of the desired surface roughness by changing the particle diameter of the glass bead included in the gas. The surface roughness to be given increases as the particle diameter of the glass bead increases.

In the present embodiment, three kinds of glass beads having different particle diameters are prepared as a first glass bead, a second glass bead, and a third glass bead. The first glass bead is a glass bead for processing the first region 120 of the contact region 110. The second glass bead is a glass bead for processing the second region 130 of the contact region 110. The third glass bead is a glass bead for processing the third regions 140 of the contact region 110. The particle diameter of the first glass bead is larger than the particle diameter of the second glass bead, and is smaller than the particle diameter of the third glass bead. That is, the particle diameter of the glass bead increases in order of the second glass bead, the first glass bead, and the third glass bead.

The blasting process includes three processes, that is, a first process, a second process, and a third process. The first process processes a portion corresponding to the first region 120 of the contact region 110 in the mold 160 using the first glass bead. The second process processes a portion corresponding to the second region 130 of the contact region 110 in the mold 160 using the second glass bead. The third process processes portions corresponding to the third regions 140 of the contact region 110 in the mold 160 using the third glass bead.

Figure 7C:
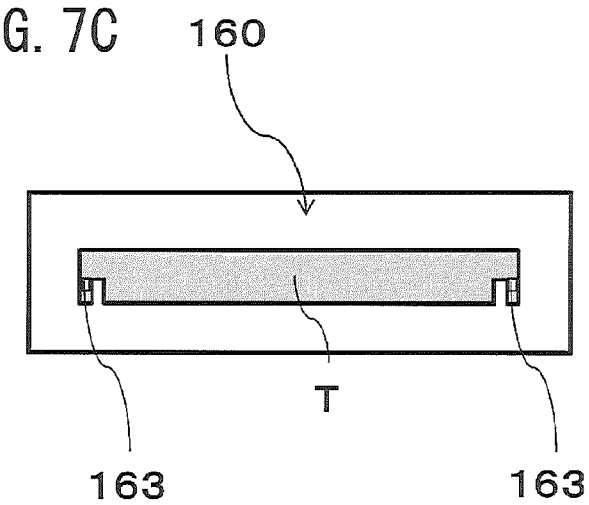
FIGS. 7A, 7B and 7C are diagrams showing the mold viewed from a spraying direction of a nozzle shown in FIG. 6.
Figure 7A:
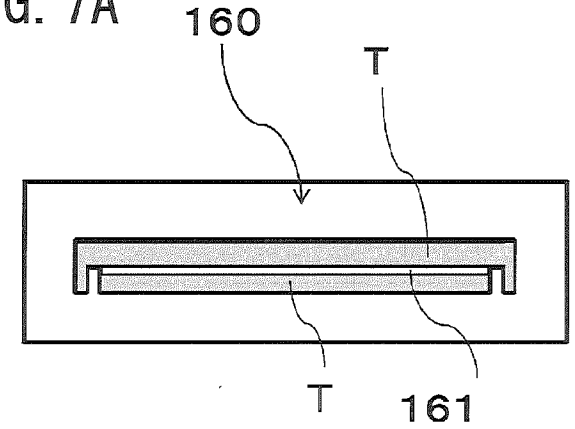
Figure 7B:
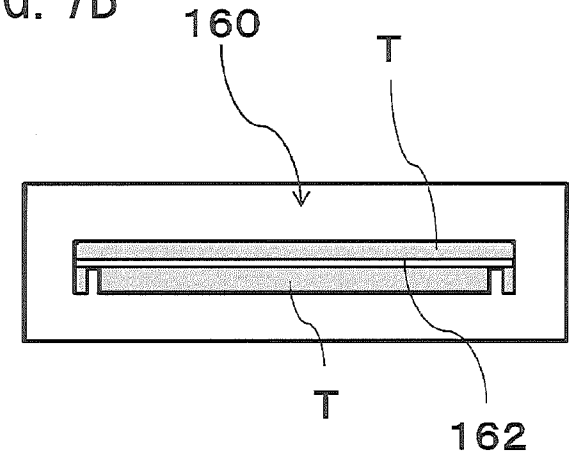

Specifically, as illustrated in FIG. 7A, the first process is performed first while masking tape T is attached to portions other than a portion 161 corresponding to the first region 120 of the rubber portion 101 in the mold 160. Then, a desired surface roughness is given only to the portion 161 corresponding to the first region 120 of the rubber portion 101 in the mold 160. Subsequently, as illustrated in FIG. 7B, the second process is performed while masking tape T is attached to portions other than a portion 162 corresponding to the second region 130 of the rubber portion 101 in the mold 160. Then, a desired surface roughness is given only to the portion 162 corresponding to the second region 130 of the rubber portion 101 in the mold 160. Subsequently, as illustrated in FIG. 7C, the third process is performed while masking tape T is attached to a portion other than portions 163 corresponding to the third regions 140 of the rubber portion 101 in the mold 160. Then, a desired surface roughness is given only to the portions 163 corresponding to the third regions 140 of the rubber portion 101 in the mold 160.

Melted urethane rubber is poured into the mold 160 subjected to the above-described processes. Subsequently, the mold 160 is cooled, and the rubber portion 101 is taken out from the cooled mold 160. Thus, the rubber portion 101 of the present embodiment is molded.

5. Advantageous Effects of First Embodiment (1) The surface roughness of the first region 120 of the contact region 110 is coarser than the surface roughness of the second region 130 of the contact region 110.

Figure 9:
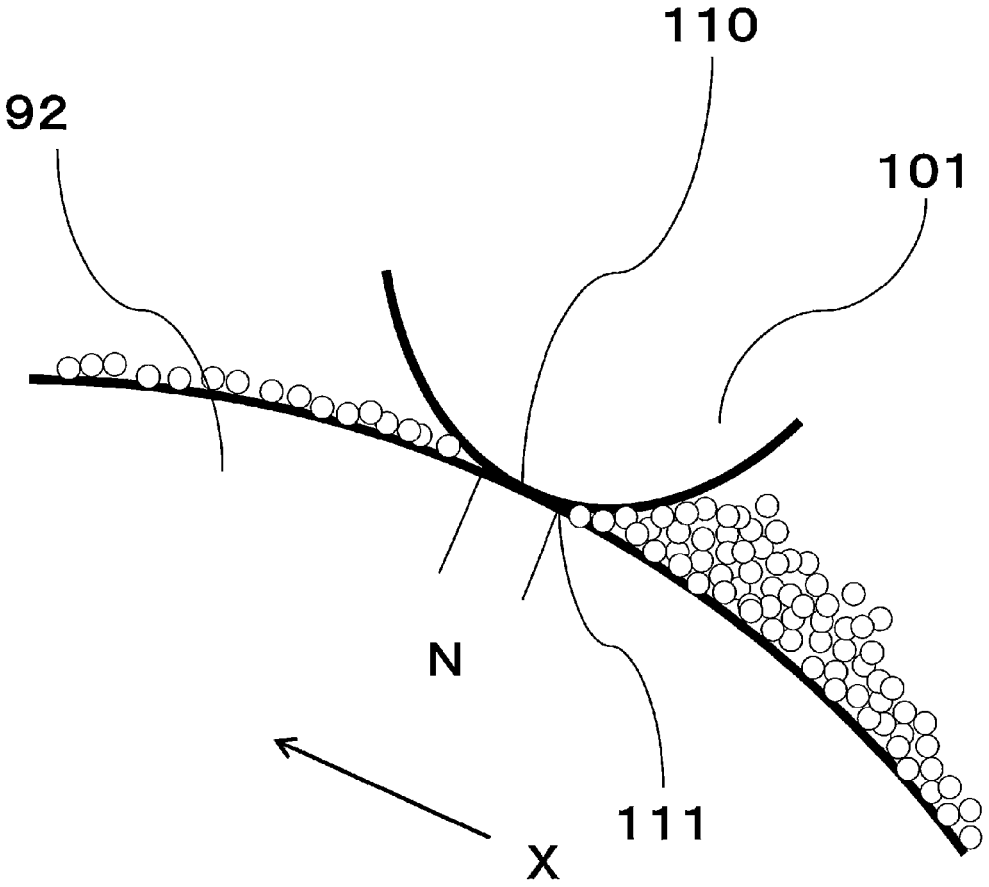
FIG. 9 is an explanatory diagram showing a contact state of the developing roller and the rubber portion with developer interposed therebetween.

As illustrated in FIG. 9, the developer layer which is carried by the developing roller 92 is thinned while passing through the nip N. At this time, most developer passes through the upstream end 111 of the contact region 110 compared to the other portion of the contact region 110. Consequently, when the surface roughness of the contact region 110 of the rubber portion 101 is fine (the arithmetic average roughness value Ra is within the range of 0.1 to 0.4), the pressure between the rubber portion 101 and the developing roller 92 increases at upstream end 111 of the contact region 110, and the friction force applied from the contact region 110 of the rubber portion 101 to the developer increases between the rubber portion 101 and the developing roller 92. Thus, the developer or the external additive released from the developer may be locally fixed to the upstream end 111 of the contact region 110 at the nip N of the developing roller 92 in the moving direction X.

According to the present embodiment, the friction force which is applied to the developer between the developing roller 92 and the upstream end 111 of the contact region 110 at the nip N of the developing roller 92 in the moving direction X decreases. Consequently, the developer or the external additive released from the developer becomes less locally fixable to the upstream end 111 of the contact region 110.

Subsequently, the developer layer which is uneven in thickness passes through the second region 130 of the contact region 110. At this time, the friction force which is applied to the developer between the developing roller 92 and the second region 130 of the contact region 10 increases compared to a case in which the developer layer passes through the first region 120. Then, the unevenness in the thickness of the developer layer decreases compared to a case in which the developer layer passes through the first region 120.

Further, when the developer layer passes through the second region 130 after the passage through the first region 120, the amount of the developer carried by the developing roller 92 decreases. Consequently, the developer or the external additive released from the developer becomes less locally fixable to the second region 130.

Further, there is no need to optimally set the surface roughness of the contact region 110 by the highly precise processing.

As a result, failures in image formation can be prevented while the blade is easily produced.

(2) The second region 130 extends toward the upstream side from the downstream end 112 of the contact region 110 at the nip N of the developing roller 92 in the moving direction X.

This configuration increases the friction force which is applied to the developer between the developing roller 92 and the downstream end 112 of the contact region 110 at the nip N of the developing roller 92 in the moving direction X. Consequently, the unevenness in the thickness of the developer layer decreases after the developer layer passes through the nip N.

As a result, failures in image formation can be further prevented.

(3) The surface roughness of each of the third regions 140 is coarser than the surface roughness of the first region 120.

According to this configuration, the amount of the developer passing through each of the third regions 140 becomes smaller than the amount of the developer passing through the first region 120. Consequently, the amount of the developer which is carried by each of the end portions of the developing roller 92 in the rotation axis direction of the developing roller 92 becomes smaller than the amount of the developer which is carried by the developing region B of the developing roller 92.

That is, the leakage of the developer can be suppressed from the end portions of the developing roller 92 in the rotation axis direction along the rotation axis direction of the developing roller 92.

(4) The second region 130 is disposed from one end 101*a* of the rubber portion 101 to the other end 101*b* thereof in the rotation axis direction of the developing roller 92.

According to this configuration, when the developing roller 92 contacts the contact region 110 of the rubber portion 101, a gap is not easily formed at the nip N of the developing roller 92 in the moving direction X between the developing roller 92 and the downstream end 112 of the contact region 110 at the nip N of the developing roller 92 in the moving direction X.

That is, the leakage of the developer can be suppressed from the end portions of the developing roller 92 in the rotation axis direction at the nip N of the developing roller 92 in the moving direction X.

<Modifications>

While the description has been made in detail with reference to the embodiment thereof, it would be apparent to those skilled in the art that various changes and modifications may be made therein without departing from the spirit and scope of the above described embodiment.

Figure 8:
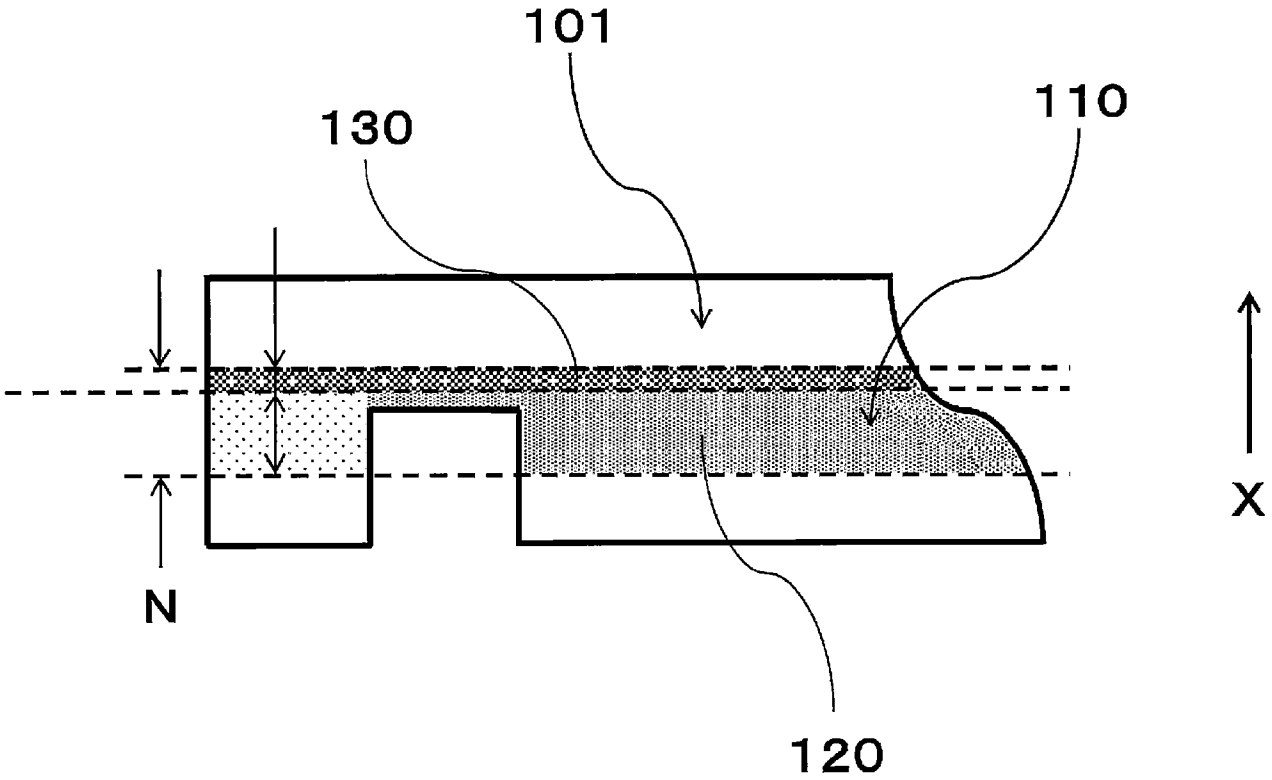
FIG. 8 is an explanatory diagram showing a configuration of a rubber portion in a modification.

In the above described embodiment, the dimension of the first region 120 at the nip N of the developing roller 92 in the moving direction X is equal to the dimension of the second region 130 at the nip N of the developing roller 92 in the moving direction X. However, the embodiment is not limited thereto. For example, as illustrated in FIG. 8, the dimension of the first region 120 may be larger than the dimension of the second region 130.

This configuration decreases the friction force which is applied to the developer between the developing roller 92 and the contact region 110 at the nip N of the developing roller 92 in the moving direction X compared to a case in which the dimension of the first region 120 is smaller than the dimension of the second region 130. That is, the developer or the external additive released from the developer becomes further less fixable to the rubber portion 101.

Further, in the above described embodiment, the second region 130 is disposed from one end 101*a* of the rubber portion 101 to the other end 101*b* thereof in the rotation axis direction of the developing roller 92. However, the embodiment is not limited thereto. For example, the dimension of the second region 130 in the rotation axis direction of the developing roller 92 may be equal to the dimension of the first region 120 in the rotation axis direction of the developing roller 92. That is, the second region 130 may be disposed in such a way as to match the width of the developing region B.

Further, in the above described embodiment, the second region 130 extends toward the upstream side from the downstream end 112 of the contact region 110 at the nip N of the developing roller 92 in the moving direction X, and is connected to the first region 120. However, the embodiment is not limited to thereto. For example, a fourth portion having a surface roughness different from those of the first region 120 and the second region 130 may be formed between the first region 120 and the second region 130.

Further, in the above described embodiment, the surface roughness of the contact region 110 may continuously decrease as it goes from the upstream end 111 of the contact region 110 toward the downstream end 112 thereof.

Further, in the above described embodiment, the contact region 110 includes the first region 120, the second region 130, the pair of third regions 140, and the pair of notches 150. However, the embodiment is not limited thereto. For example, the contact region 110 of the rubber portion 101 may include only the first region 120 and the second region 130.

Further, in the above described embodiment, the mold 160 for molding the rubber portion 101 is formed by the blasting process. However, the embodiment is not limited thereto. For example, the mold 160 for molding the rubber portion 101 may be formed by an electro-discharge machining process or an etching process.

What is claimed is:

1. A developing device comprising:

a developing roller that is rotatable about a rotation axis defining an axial direction, the developing roller having an outer peripheral surface movable in a moving direction upon rotation of the developing roller to transfer developing agent to a developing region having a width in the axial direction; and a thickness regulation blade comprising:

a support portion; and a rubber portion supported by the support portion and providing a contact region in contact with the outer peripheral surface to provide a nip region relative to the developing roller, the contact region including:

a first region extending in the axial direction by a length at least equal to or greater than the width of the developing region, and positioned in alignment with the developing region in the moving direction, the first region having a first surface roughness within a range of 0.5 μm to 0.8 μm; and a second region extending in the axial direction by a length at least equal to or greater than the width of the developing region, and positioned in alignment with the developing region in the moving direction, the second region being positioned downstream of the first region in the moving direction and having a second surface roughness finer than the first surface roughness.

2. The developing device as claimed in claim 1, wherein the contact region has an upstream edge in the moving direction, and the first region extends downstream in the moving direction from the upstream edge.

3. The developing device as claimed in claim 1, wherein the contact region has a downstream edge in the moving direction, and the second region extends upstream in the moving direction from the downstream edge.

4. The developing device as claimed in claim 1, wherein the first region has a downstream edge in the moving direction, and the second region has an upstream edge in the moving direction, the downstream edge being aligned with the upstream edge in the moving direction.

5. The developing device as claimed in claim 1, wherein the first region has a first length in the moving direction, and the second region has a second length in the moving direction, the first length being equal to or greater than the second length.

6. The developing device as claimed in claim 1, wherein the first surface roughness is within a range of 0.6 μm to 0.7 μm.

7. The developing device as claimed in claim 1, wherein the second surface roughness is within a range of 0.1 μm to 0.4 μm.

8. The developing device as claimed in claim 7, wherein the second surface roughness is within a range of 0.2 μm to 0.3 μm.

9. The developing device as claimed in claim 1, wherein the rubber portion has a first end and a second end in the axial direction, the second region extending from the first end to the second end in the axial direction.

10. A developing device, comprising:

a developing roller that is rotatable about a rotation axis defining an axial direction, the developing roller having an outer peripheral surface movable in a moving direction upon rotation of the developing roller to transfer developing agent to a developing region having a width in the axial direction; and a thickness regulation blade comprising:

a support portion; and a rubber portion supported by the support portion and providing a contact region in contact with the outer peripheral surface to provide a nip region relative to the developing roller, the contact region including:

a first region extending in the axial direction by a length at least equal to or greater than the width of the developing region, and positioned in alignment with the developing region in the moving direction, the first region having a first surface roughness; and a second region extending in the axial direction by a length at least equal to or greater than the width of the developing region, and positioned in alignment with the developing region in the moving direction, the second region being positioned downstream of the first region in the moving direction and having a second surface roughness finer than the first surface roughness;

wherein the second region includes a first extension region and a second extension region extending in the axial direction, and the first region has a first end and a second end in the axial direction, the first extension region and the second extension region being positioned outward of the first end and the second end in the axial direction, respectively, the first extension region and the second extension region having a first upstream edge and a second upstream edge in the moving direction, respectively;

wherein the contact portion further includes a pair of third regions extending upstream in the moving direction from the first upstream edge and the second upstream edge respectively, the third region having a third surface roughness coarser than the first surface roughness.

11. The developing device as claimed in claim 10, wherein the third surface roughness is within a range of 0.8 μm to 1.4 μm.

12. The developing device as claimed in claim 11, wherein the third surface roughness is within a range of 1.0 μm to 1.2 μm.

13. The developing device as claimed in claim 11, wherein the first surface roughness is within a range of 0.5 μm to 0.8 μm; and wherein the second surface roughness is within a range of 0.1 μm to 0.4 μm.

14. A developing device comprising:

a developing roller that is rotatable about a rotation axis defining an axial direction, the developing roller having an outer peripheral surface movable in a moving direction upon rotation of the developing roller to transfer developing agent to a developing region having a width in the axial direction; and a thickness regulation blade comprising:

a support portion; and a rubber portion supported by the support portion and extending in the axial direction, the rubber portion having an upstream end in the moving direction, a first end portion and a second end portion in the axial direction where a first notch and a second notch are formed, respectively, the first notch and the second notch each having an open end at the upstream end, an inner side surface extending in the moving direction, an outer side surface extending in the moving direction and positioned outward of the inner side surface in the axial direction, and a bottom surface, the inner surface of the first notch and the inner surface of the second notch being aligned with a boundary of the developing region in the moving direction;

the rubber portion providing a contact region in contact with the outer peripheral surface to provide a nip region relative to the developing roller, the contact region including:

a first region extending in the axial direction from the inner surface of the first notch to the inner surface of the second notch, the first region having a first surface roughness; and a second region extending in the axial direction from a portion outward of the outer surface of the first notch to a portion outward of the outer surface of the second notch, the second region being positioned downstream of the first region in the moving direction and having a second surface roughness finer than the first surface roughness.

15. The developing device as claimed in claim 14, wherein the first region has a downstream edge in the moving direction, the downstream edge being aligned with the bottom surface in the axial direction.

16. The developing device as claimed in claim 14, wherein the second region has an upstream edge in the moving direction, the upstream edge being aligned with the bottom surface in the axial direction.

17. The developing device as claimed in claim 14, wherein the first region has a downstream edge in the moving direction, and the second region has an upstream edge in the moving direction, the downstream edge being aligned with the upstream edge in the moving direction.

18. The developing device as claimed in claim 14, wherein the contact region further includes a third region extending in the axial direction and positioned outward of each outer surface of each of the first notch and the second notch in the axial direction, the third region being positioned upstream of the second region in the moving direction, and the third region having a third surface roughness coarser than the first surface roughness.

19. The developing device as claimed in claim 18, wherein the third region has a downstream edge in the moving direction in alignment with the bottom surface.

* * * * *